US011965720B2

(12) United States Patent
Herren et al.

(10) Patent No.: US 11,965,720 B2
(45) Date of Patent: Apr. 23, 2024

(54) WARHEAD WITH ASYMMETRIC INITIATION

(71) Applicant: Saab Bofors Dynamics Switzerland Ltd., Thun (CH)

(72) Inventors: Christian Herren, Liebefeld (CH); Franz Häller, Vordemwald (CH)

(73) Assignee: Saab Bofors Dynamics Switzerland Ltd., Thun (CH)

( * ) Notice: Subject to any disclaimer, the term of this patent is extended or adjusted under 35 U.S.C. 154(b) by 346 days.

(21) Appl. No.: 17/294,465

(22) PCT Filed: Nov. 20, 2018

(86) PCT No.: PCT/CH2018/000045
§ 371 (c)(1),
(2) Date: May 17, 2021

(87) PCT Pub. No.: WO2020/102915
PCT Pub. Date: May 28, 2020

(65) Prior Publication Data

US 2022/0011079 A1 Jan. 13, 2022

(51) Int. Cl.
*F42B 12/22* (2006.01)
*F42C 19/095* (2006.01)
*F42C 19/08* (2006.01)

(52) U.S. Cl.
CPC ..... *F42B 12/22* (2013.01); *F42C 19/095* (2013.01); *F42C 19/0842* (2013.01); *F42C 19/0846* (2013.01)

(58) Field of Classification Search
CPC ..... F42B 12/22; F42B 12/24; F42B 12/26; F42B 12/28; F42B 13/30; F42B 12/32;
(Continued)

(56) References Cited

U.S. PATENT DOCUMENTS 3,896,731 A * 7/1975 Kilmer ..... F42C 19/0846 102/305
4,475,461 A * 10/1984 Durrell ..... F42C 19/0846 102/200

(Continued)

FOREIGN PATENT DOCUMENTS

EP 0107534 A1 5/1984
EP 0570032 A2 11/1993
FR 2896577 A1 7/2007

OTHER PUBLICATIONS

International Search Report dated Jul. 5, 2019 filed in PCT/CH2018/000045.

*Primary Examiner* — James S Bergin
(74) *Attorney, Agent, or Firm* — Rankin, Hill & Clark LLP

(57) ABSTRACT

Warhead (20) with asymmetric initiation comprising an inner explosive charge and a tubular structure (1) and being connectable to detonator means and target sensor (106) for activating the detonator means, whereby the tubular structure (1) comprises a wall (6) and a central cavity (7) for the inner explosive charge, an outer diameter D0) an inner diameter $D_I$, a wall thickness T=0.5 ($D_O$–$D_I$), a front end (2), a rear end (4), a central axis (10) connecting the front end (2) and the rear end (4), a length L measured parallel to the central axis (10) and an inner surface (8) facing the central cavity (7) and an outer surface (9) and the warhead further comprises a fragmentable material adjacent to the outer surface (9) of the tubular structure (1), whereby the wall (6) comprises a plurality of bores (12) angularly and/or axially spaced from each other and extending from the outer surface (9) in direction to the inner surface (8), the bores (12) are filled with an explosive substance (19), the outer surface (9) of the wall (6) is provided with a plurality of channels (11) and/or a plurality of channels (11) is provided within the
(Continued)

wall (9), whereby the plurality of channels (11) connects at least a part of the plurality of the bores (12) and is filled with an explosive substance and the plurality of bores (12) is connected to a detonator by means of an explosive substance provided in the plurality of channels (11).

16 Claims, 3 Drawing Sheets

(58) Field of Classification Search
CPC .. F42C 19/08; F42C 19/0838; F42C 19/0842; F42C 19/0846
USPC ..... 102/491–497
See application file for complete search history.

(56) References Cited

U.S. PATENT DOCUMENTS

| | | | |
|---|---|---|---|
| 4,920,079 | A | 4/1990 | Kaeser et al. |
| 5,182,418 | A | 1/1993 | Talley |
| 5,354,519 | A | 10/1994 | Kaeser |
| 8,479,653 | B2 | 7/2013 | Bar et al. |

* cited by examiner

WARHEAD WITH ASYMMETRIC INITIATION

BACKGROUND OF THE INVENTION

1. Field of the Invention

The invention relates to a warhead as disclosed and claimed herein, and to an ammunition unit comprising a warhead as disclosed and claimed herein.

2. Description of the Related Art

Several ammunition units comprising warheads with explosive charges are already known in prior art. Such typical warheads consist of explosive charges surrounded by a fragmenting metal case, whereby the fragments are sprayed out around the explosive charge after the detonation. However, the kinetic energy of the fragments not hitting the target is lost.

What is therefore needed is an improved warhead allowing to increase the kinetic energy of the generated fragments in the direction of the target at the expense of the kinetic energy of the missing fragments.

BRIEF SUMMARY OF THE INVENTION

It is an object of the invention to provide a warhead allowing the increase of the kinetic energy of the crucial fragments hitting the target.

The invention solves the posed problem with a warhead comprising the features disclosed and claimed herein, and an ammunition body with a warhead comprising the features as disclosed and claimed herein.

The advantages of the warhead according to the invention are to be seen in the fact that instead of the well-known central initiation, the detonation of the warhead according to the present invention is initiated by means of a channel system being provided either on the outer surface of the tubular structure of the warhead and/or within the wall of the tubular structure, which is filled with explosive substances so that the initiation of the explosive charge placed in the cavity of the warhead occurs in the regions, where detonatively connecting bores are provided in the tubular structure.

The design (shape and geometrical pattern) of the channels allows an optimal initiation of the explosive substance located in the bores depending on the kind of explosive.

The depth or diameter of the channels should be small enough in order to avoid a premature initiation of the underlying main explosive and large enough to allow propagation of a detonation.

Thereby the detonation wave in the main explosive charge is shaped in such a way that the fragments situated on the opposite side of the related bores will be optimally accelerated. The bores must not be necessarily through holes but can also be pocket holes. However, the presence of a plurality of bore/channel systems which are angularly spaced from each other is important so that the initiation of detonation can be selectively chosen at the region of the warhead which is facing the target at the longest crossing distance.

Compared to prior art devices utilizing large-surface explosive layers the warhead according to the invention with Its tubular structure comprising a plurality of bores allows a more precise timing and more detailed wave-shaping of the detonation wave. As a consequence the effectivity of the fragments produced is optimized.

The channel system has an additional advantage since it allows also a timing of the bore initiation along the longitudinal axis of the warhead, so that an additional directional effect of the fragment spray can be obtained.

Furthermore the channel systems of the tubular structure according to the invention offer more freedom for the placement of the detonators.

In the context of this invention the following definitions shall be used:

Theoretical Maximum Density (TMD)

The TMD corresponds to the upper limit of the density to which the explosive substance can be theoretically pressed. Isostatically Pressing.

This known process is described in detail in U.S. Pat. No. 4,920,079 and in EP-A 0.570.032

Further advantageous embodiments of the invention can be commented as follows:

In a special embodiment of the warhead the bores are through holes perforating the inner surface and running into the central cavity.

In a further embodiment at least part of the bores are located at the end points of the channels.

In a further embodiment the depth C of the channels on the outer surface or the diameter of the channels within the wall is in the range of $0.2\ T<C<0.8\ T$ and preferably in the range of $0.3\ T<C<0.5\ T$.

In an additional embodiment the depth C of the channels on the outer surface or the diameter of the channels within the wall is smaller than 3 mm, preferably smaller than 2 mm.

In a further embodiment the depth of the bores is larger than depth C of the channel, preferably more than 100% larger.

In an additional embodiment the cross sectional area of the bores is larger than the cross sectional area of the channels, preferably more than 100% larger.

In a special embodiment the entity of all channels has a volume v, which is smaller than 15% of the theoretical volume $V=0.25\pi L\ (D_o^2-D_i^2)$ of the tubular structure without channels. The advantage of the relationship of the size/volume of the channels relative to the size/volume of the tubular structure is to be seen in the fact that due to the relative fine structure of the channels the dimensions of a warhead comprising such a tubular structure between the explosive charge in the cavity and an outer shell can be kept relatively small. Otherwise, if the volume of the explosive in the channels would be too high the detonation of the explosive charge would take place before achieving the bores, i.e. before reaching the explosive in the cavity of the tubular structure, and therefore would occur on the outer surface of the tubular structure of the warhead, which would result in the explosion of the warhead too early and significantly reduce the kinetic energy of the fired fragments.

In a further embodiment the dimensions of the channels are minimal but still large enough so that detonation of the explosive substance in the channels is guaranteed.

In an additional embodiment at least a part of the channels is interconnected to each other.

In a special embodiment the plurality of the channels and/or bores are divided angularly in at least two sectors, preferably three, four, five or six sectors.

In a special embodiment the channels and/or bores of the same sector are connected to each other but not connected with the channels and/or bores of another sector.

In a further embodiment at least one channel and/or through bore of each sector is connected to a detonator.

In an additional embodiment the warhead comprises a plurality of detonators, whereby each sector is connected to another detonator. This embodiment allows an asymmetric initiation of the warhead and consequently firing with a higher kinetic energy in a desired direction.

In a special embodiment the explosive substance (19) is selected from the group of: pentaerythrit, trinitrotoluene (TNT), hexanitrostilbene (HNS), hexogen (RDX), and octogen (HMX).

In a further embodiment the explosive substance in the channels and in the bores belongs to a first type of explosive and the inner explosive charge belongs to a second type of explosive.

In a further embodiment the density of the explosive substance in the channels and the bores is at least 70%, preferably at least 90% of the theoretical maximum density (TMD) of the explosive substance.

In a special embodiment the channels and the bores are filled with the explosive substance by the process of isostatically pressing.

In a further embodiment the bores and/or channels are distributed over the wall symmetrically relative to virtual planes comprising the central axis.

In a further embodiment the wall thickness T is maximum 5 mm, preferably maximum 3 mm.

In a special embodiment the orthogonal section of the channels is U-shaped.

In further embodiment the diameter of the bores is maximum 5 mm, preferably maximum 4 mm.

In a special embodiment of the method for manufacturing and preparing the tubular structure of the warhead the channels filled with an explosive material are subsequently sealed.

In a special embodiment of the tubular structure for use in a warhead the outer surface is provided with a plurality of channels and/or a plurality of channels is provided within the wall, whereby the channels are connected to the holes.

In a further embodiment the depth C of the channels on the outer surface or the diameter of the channels within the wall of the tubular structure is in the range of $0.2\ T<C<0.8\ T$ and preferably in the range of $0.3\ T<C<0.5\ T$.

In a further embodiment the channels and the bores of the tubular structure are filled with an explosive substance.

In a special embodiment an ammunition unit comprising a warhead further comprises a target sensor and a fuse. Examples of such ammunition units are missiles, torpedos or rockets.

In a further embodiment the outer surface of the tubular structure comprises plurality of fragments being preferably interconnected to each other by means of a matrix, in which each fragment is at least partially embedded. The matrix may comprise the following materials: polymer and/or reactive metal foam.

A BRIEF DESCRIPTION OF THE DRAWINGS

Several embodiments of the invention will be described in the following by way of example and with reference to the accompanying drawings in which.

DETAILED DESCRIPTION OF THE INVENTION

Figure 1:
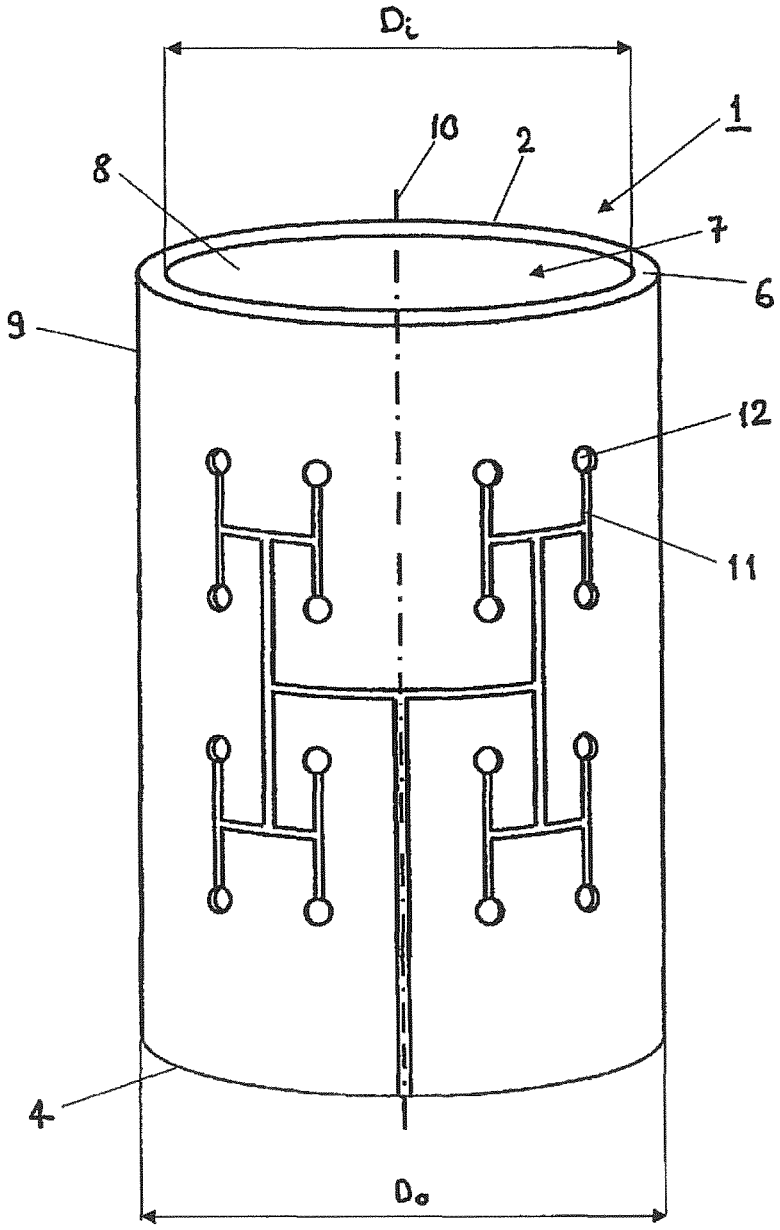
FIG. 1 illustrates a perspective schematic view of a tubular structure of a warhead according to the invention.

FIG. 1 illustrates a tubular structure 1 of a warhead 20 according to the present invention. The tubular structure 1 comprises a wall 6 and a central cavity 7 for an inner explosive charge to be placed therein. The tubular structure has a front end 2, a rear end 4 and a central axis 10 connecting the front end 2 and the rear end 4. The tubular structure 1 has an outer diameter $D_O$ and an inner diameter $D_I$ as well as a wall thickness being equivalent to $T=0.5\ (D_O-D_I)$ and a length $L>0$ measured parallel to the central axis 10. The tubular structure comprises an inner surface 8 facing the central cavity 7 and an outer surface 9. The wall 6 of the tubular structure 1 is provided with a plurality of bores 12 penetrating into the wall 6 from the outer surface 9 of the tubular structure 1. The bores 12 being suitable to be filled with an explosive substance.

The bores 12 are arranged in the tubular structure 1 with their bore axes extending at different central angles with respect to a reference radius of the tubular structure 1 and/or with their bore axes extending at different spacings from the rear end 4 of the tubular structure 1 measured in the direction of the central axis 10.

Typically, if there are no compatibility problems the bores 12 are configured as through bores 12 perforating the inner surface 8 of the tubular structure 1 and running into the central cavity 7 of the tubular structure 1. Else the depth of the bores is exemplarily in the range of 75% to 95% of the wall thickness.

Furthermore, each of the bores 12 has a diameter d, which can be exemplarily, but not limiting 4 mm. If some or all of the bores 12 have a different diameter, the diameters of the bores 12 are in a range between 2 mm and 5 mm.

The wall 6 of the tubular structure 1 shown in FIG. 1 is further provided with a plurality of channels 11, wherein the channels 11 form a number of channel systems each comprising channels 11 which are interconnected with each other. Each channel system connects a number of the bores 12 together. Furthermore, the channels 11 connect all of the bores 12 to a detonator (not shown in FIG. 1).

The number of channel systems formed by interconnected channels 11 is typically multiple and then the bores 12 that are connected by means of the channels 11 of the respective channel system are arranged in at least two different (angularly separated) segments of the peripheral surface of the tubular structure 1.

Furthermore, a channel system in one of the different segments or wall portions is not connected to the channel systems of the other segments or wall portions. Exemplarily, one channel 11 and/or bore 12 of each channel system is connected to a detonator.

According to the embodiment of FIG. 1 the detonator of the warhead 12 is placed outside of the tubular structure. However, alternative embodiments of a warhead with a detonator being placed within the tubular structure 1 are possible which are also is fully functional.

According to the schematic view of FIG. 1 the plurality of the bores 12 are placed in only one section of the tubular structure 1. However, the plurality of the bores 12 can be placed over the complete tubular structure 1, whereby the plurality of the trough bores 12 is connected by means of the channels 11 provided either on the outer surface 9 and/or within the wall 9 of the tubular structure 1 to at least one detonator.

The main explosive charge will be initiated at the position of the bores in a timed fashion by the detonation running through the channels.

In a special embodiment the plurality of the bores 12 are angularly divided in plurality of sectors, whereby the through bores 12 of each angular sector are connected to another detonator as the bores 12 of another sector. A target sensor 106 (FIG. 3) capturing the position of a target can then supply the information which detonator has to be initiated for obtaining the optimal effect of high kinetic energy of the presumably hitting fragments.

Figure 2:
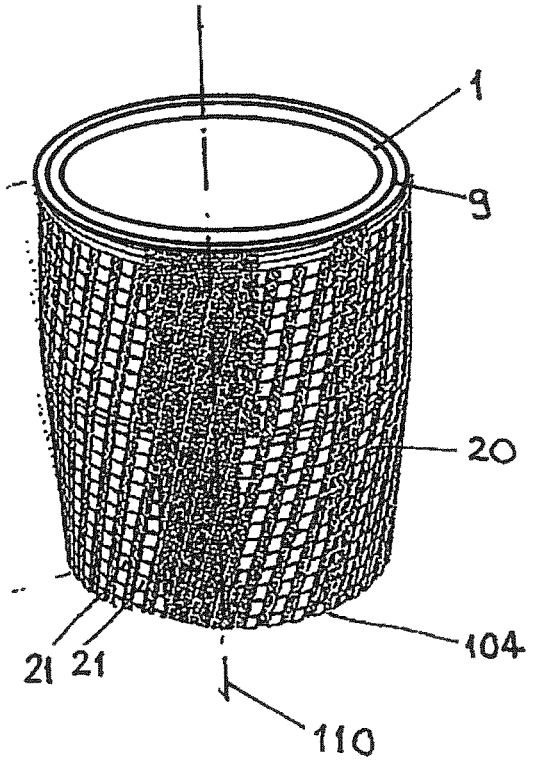
FIG. 2 illustrates a perspective view of a warhead according to the invention.

FIG. 2 illustrates an embodiment of the warhead 20 according to the invention comprising the tubular structure 1 of FIG. 1 and a fragmental material adjacent the outer surface 9 of the tubular structure 1. The fragmental material includes a plurality of fragments 21 which are exemplarily, but not limiting, interconnected to each other by means of a matrix made of a polymer in which each fragment 21 is at least partially embedded. Alternatively, the matrix comprises a reactive metal foam.

Figure 3:
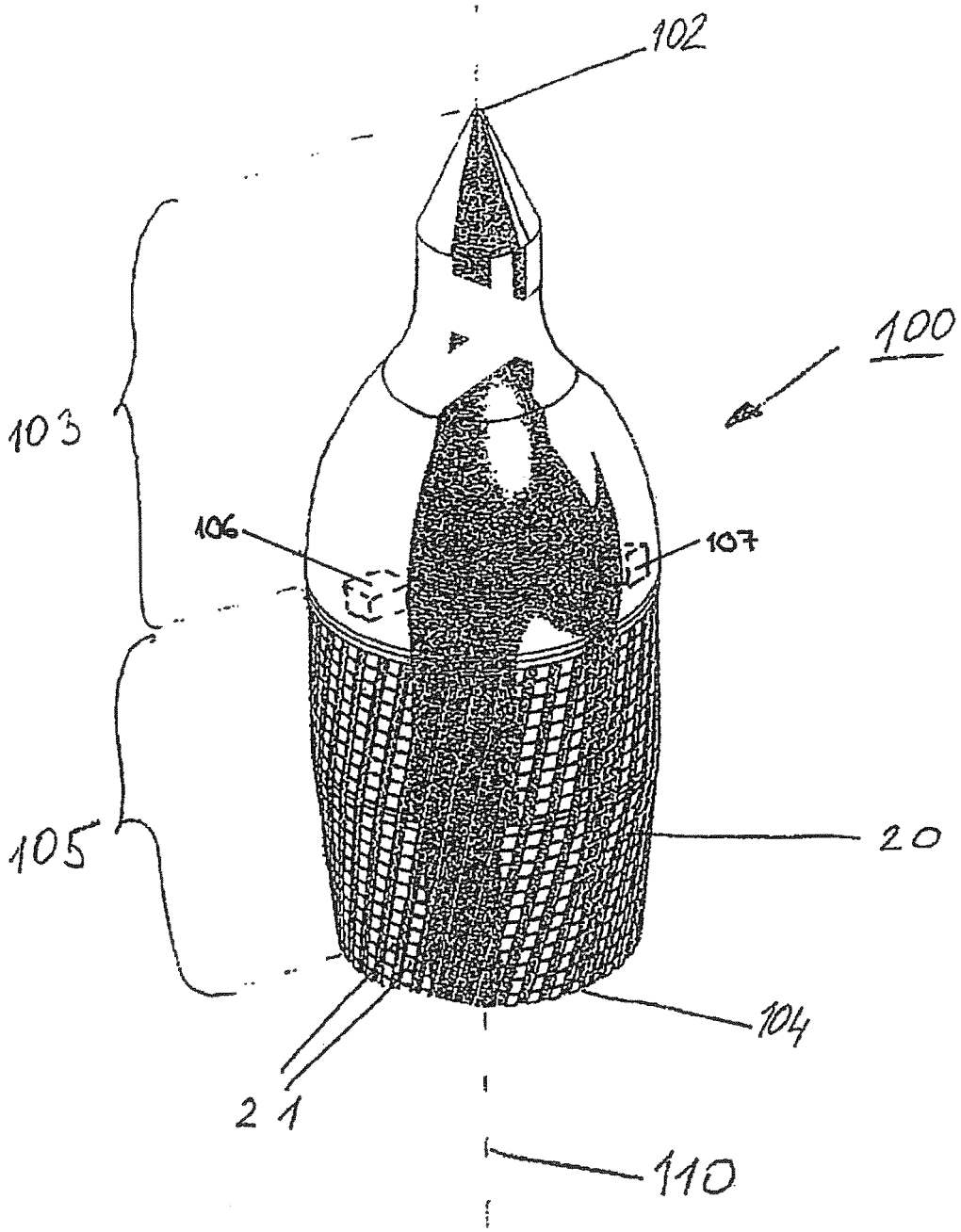
FIG. 3 illustrates a perspective view of an embodiment of an ammunition unit comprising a warhead according to the present invention.

FIG. 3 shows an ammunition unit 100 (missile) being suitable to carry a warhead 20 to the target. The missile 100 comprises a forward end 102 and front region 103 adjoining the forward end 102 and a backward end 104 and a backward region 105 adjoining the backward end 104 and comprising a warhead 20 according to the present invention. The missile further comprises a middle axis 110 connecting the forward end 102 and the backward end 104 of the missile, whereby the middle axis 110 is coincident with the central axis 10 of the tubular structure 1 of the warhead 20, whereby the both axes are also coincident with the roll axis of the fired missile. Further, the ammunition unit 100 comprises an azimuthal target sensor 106 and a fuse 107.

As shown in FIG. 3 a plurality of fragments 21 are placed on the outer surface 9 of the tubular structure of the warhead 20 of the ammunition unit 100. The fragments 21 comprise a plurality of pre-formed fragments (spherical and non-spherical), whereby the fragments are partially embedded in a matrix for their fixation on the outer surface of the tubular structure 1.

Although the invention has been described in conjunction with specific embodiments thereof, it is evident that many alternatives, modifications and variations will be apparent to those skilled in the art. Accordingly, it is intended to embrace all such alternatives, modifications and variations that fall within the scope of the appended claims.

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable subcombination or as suitable in any other described embodiment of the invention. Certain features described in the context of various embodiments are not to be considered essential features of those embodiments, unless the embodiment is inoperative without those elements.

The invention claimed is:

1. A warhead with asymmetric initiation comprising:

an inner explosive charge; and a tubular structure;

wherein the warhead is connectable to detonator means and target sensor for activating the detonator means;

wherein the tubular structure comprises a wall and a central cavity for the inner explosive charge, the tubular structure having an outer diameter $D_O$, an inner diameter $D_I$, a wall thickness $T=0.5\times(D_O-D_I)$, a front end, a rear end, a central axis connecting the front end and the rear end and a length L measured parallel to the central axis, an inner surface facing the central cavity and an outer surface;

wherein the warhead further comprises a fragmentable material adjacent to the outer surface of the tubular structure;

wherein the wall comprises a plurality of bores angularly and/or axially spaced from each other and extending from the outer surface in a direction toward the inner surface;

wherein the bores are filled with an explosive substance by means of isostatic pressing;

wherein the outer surface of the wall is provided with a plurality of channels and/or a plurality of channels are provided within the wall;

wherein the plurality of channels connect at least a part of the plurality of the bores and are also filled with the explosive substance by means of isostatic pressing;

wherein the plurality of bores are connected to a detonator by means of the explosive substance provided in the plurality of channels; and wherein the depth C of the plurality of channels on the outer surface or the diameter of the plurality of channels provided within the wall is in the range of $0.2\ T<C<0.8\ T$;

wherein the depth of the plurality of bores is greater than depth C of the plurality of channels; and wherein the entirety of all of the plurality of channels has a volume v, which is smaller than 15% of a theoretical volume $V=0.25\pi L\,(D_O^2-D_I^2)$ of the tubular structure if the tubular structure had no channels.

2. The warhead according to claim 1, wherein the plurality of bores are through holes perforating the inner surface and running into the central cavity.

3. The warhead according to claim 1, wherein at least part of the plurality of bores are located at end points of the plurality of channels.

4. The warhead according to claim 1, wherein the depth C of the plurality of channels on the outer surface or the diameter of the plurality of channels within the wall is in the range of $0.3\ T<C<0.5\ T$.

5. The warhead according to claim 1, wherein the depth of the plurality of bores is more than 100% greater than depth C of the plurality of channels.

6. The warhead according to claim 1, wherein a cross-sectional area of the plurality of bores is larger than a cross-sectional area of the plurality of channels.

7. The warhead according to claim 1, wherein at least a part of the plurality of channels are interconnected to each other.

8. The warhead according to claim 1, wherein the plurality of the channels and/or the plurality of bores are divided angularly in at least two sectors.

9. The warhead according to claim 8, wherein the plurality of channels and/or the plurality of bores of the same sector are connected to each other but are not connected with the plurality of channels and/or the plurality of bores of another sector.

10. The warhead according to claim 8, wherein at least one of the plurality of channels and/or at least one of the plurality of bores of each sector is connected to a detonator.

11. The warhead according to claim 8, wherein the warhead comprises a plurality of detonators, and wherein each sector is connected to at least one of the plurality of detonators.

12. The warhead according to claim 1, wherein the explosive substance that fills the plurality of bores and the plurality of channels is selected from the group consisting of pentaerythrit, trinitrotoluene (TNT), hexanitrostilbene (HNS), hexogen (RDX), and octogen (HMX).

13. The warhead according to claim 12, wherein the explosive substance filled in the plurality of channels and in the plurality of bores is a different type of explosive than the inner explosive charge.

14. The warhead according to claim 1, wherein the plurality of bores and/or the plurality of channels are distributed over the wall symmetrically relative to virtual planes comprising the central axis.

15. The warhead according to claim 1, wherein an orthogonal section of the plurality of channels is U-shaped.

16. An ammunition unit comprising a warhead according to claim 1, a target sensor and a fuse.

* * * * *